US008734090B2

(12) United States Patent
Lewis

(10) Patent No.: US 8,734,090 B2
(45) Date of Patent: May 27, 2014

(54) COMBINATION OF MECHANICAL ACTUATOR AND CASE COOLING APPARATUS

(75) Inventor: Leo V. Lewis, Kenilworth (GB)

(73) Assignee: Rolls-Royce PLC, London (GB)

( * ) Notice: Subject to any disclaimer, the term of this patent is extended or adjusted under 35 U.S.C. 154(b) by 1165 days.

(21) Appl. No.: 12/689,661

(22) Filed: Jan. 19, 2010

(65) Prior Publication Data

US 2010/0209231 A1 Aug. 19, 2010

(30) Foreign Application Priority Data

Feb. 16, 2009 (GB) ..... 0902420.9

(51) Int. Cl.
*F01D 25/26* (2006.01)

(52) U.S. Cl.
USPC ..... 415/136; 415/173.2

(58) Field of Classification Search
USPC ..... 415/134, 136, 126, 173.1, 173.2, 174.1
See application file for complete search history.

(56) References Cited

U.S. PATENT DOCUMENTS

| | | | | |
|---|---|---|---|---|
| 5,096,375 | A * | 3/1992 | Ciokailo | 415/173.2 |
| 5,116,199 | A * | 5/1992 | Ciokajlo | 415/173.2 |
| 2005/0042080 | A1 * | 2/2005 | Gendraud et al. | 415/173.1 |
| 2008/0267769 | A1 | 10/2008 | Schwarz et al. | |

FOREIGN PATENT DOCUMENTS

| | | |
|---|---|---|
| GB | 1083373 | 9/1967 |
| GB | 2 412 946 A | 10/2005 |

OTHER PUBLICATIONS

British Search Report issued in British Application No. GB1106706.3 on May 3, 2011.
British Search Report issued in British Patent Application No. GB0902420.9; Date of Search: May 28, 2009.

* cited by examiner

*Primary Examiner* — Dwayne J White
(74) *Attorney, Agent, or Firm* — Oliff PLC

(57) ABSTRACT

A rotor blade tip clearance control apparatus for a gas turbine engine includes a plurality of circumferentially distributed segments which form an annular shroud surrounding the outer tips of a row of rotor blades. A mechanical arrangement is operatively connected to the segments. Actuation of the arrangement causes the segments to move in a radial direction thereby controlling a clearance between the segments and the outer tips. A case cooling system supplies cooling air to an engine case to which the segments are mounted. The cooling air regulates thermal expansion of the case and thereby also controls the clearance between the segments and the outer tips.

12 Claims, 2 Drawing Sheets

COMBINATION OF MECHANICAL ACTUATOR AND CASE COOLING APPARATUS

Figure 1A:
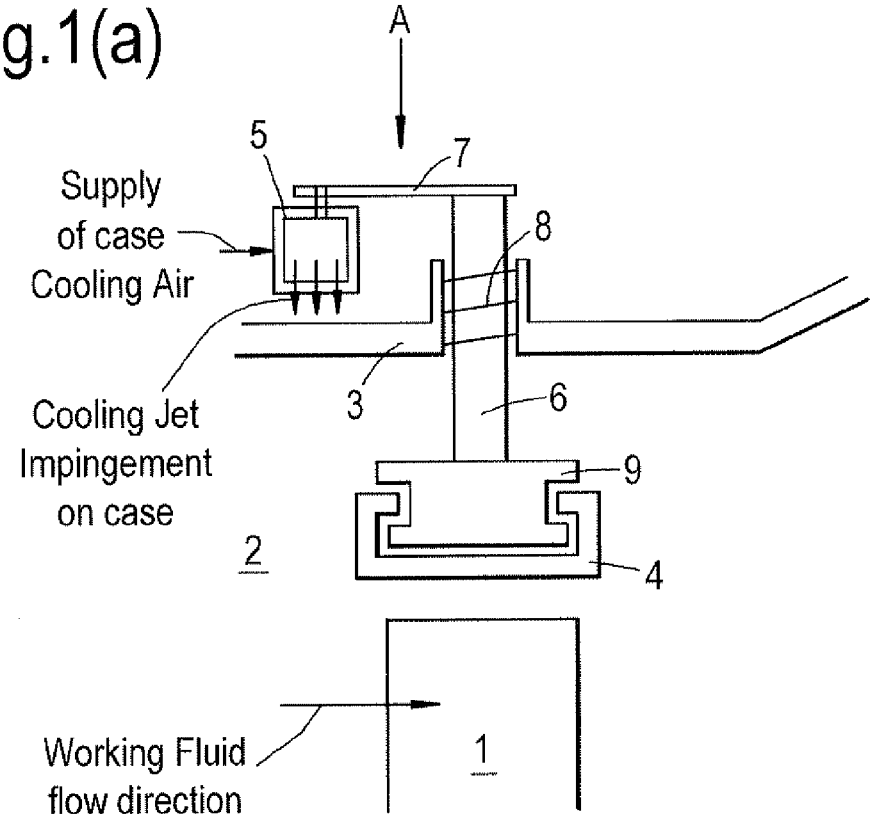

The present invention relates to a combination of a mechanical actuator and a case cooling apparatus for a gas turbine engine.

Aero gas turbine engines have a plurality of compressor stages, each stage comprising a set of stator vanes which receive and redirect the working fluid issuing from the rotating blades of the preceding stage. Aero engines have to operate at varying speeds and inlet conditions, and it is advantageous to be able to alter the aerodynamic flow angle of the individual stator vanes within the gas turbine annulus depending upon the present engine operating speed and conditions.

Unison rings are commonly used on compressor stages of aero gas turbine engines to rotate stator vanes about their radial axes and thereby change the aerodynamic flow angle.

Each unison ring encircles the engine and is rotated by one or more actuators to produce movement in the circumferential direction. This movement is converted by an arrangement of levers and spindles into the rotation of the stator vanes.

Similarly, the turbine stages of aero gas turbine engines have stator vanes (often known as nozzle guide vanes) for receiving and redirecting working fluid flows. To promote efficient operation of turbine stages, it has also been proposed to alter the aerodynamic flow angle of turbine stator vanes using unison ring arrangements.

Efficient operation of rotors is also promoted by reducing the leakage of working fluid between the engine casing and the tips of the rotor blades. For example, engine-casing cooling systems allow the clearance between a turbine stage casing and the rotor blade tips of the stage to be adjusted so that tip clearance, and hence tip leakage, can be reduced.

In large civil aero engines, engine casing cooling air is typically taken from the fan stream or from an early compressor stage. It is then fed to a manifold which encircles the engine at or near the plane of the target turbine stage. On exit from the manifold, the air impinges on the outside of the turbine stage casing, causing it to contract and reduce the rotor blade tip clearance.

Although engine-casing cooling systems are commonly used, they have disadvantages. In particular, it typically takes two to five minutes to heat a casing and longer to cool it. Therefore such systems do not compensate well for tip clearance effects that occur during fast engine transients. This has a knock-on effect on steady state clearances, which must be larger than necessary to compensate for transient events.

Tip clearance control by mechanical actuation of shroud segments has also been proposed. See for example U.S. Pat. No. 5,035,573. An advantage over thermal systems which act on the casing is that the segments can be retracted away from the rotor tip fast enough during engine accelerations to negate the rotor tip growth arising from the combination of rotor assembly centrifugal growth and the rapid heating of the aerofoil length. However, a drawback is that the removal of the case cooling manifold means that the full range of movement through thermal transients needs to be accommodated by the mechanical actuator. The large range of movement causes problems with sealing and with distortion of mechanical components, and also difficulties in retaining the required resolution on positional accuracy.

In general terms, the present invention provides a rotor blade tip clearance control apparatus for a gas turbine engine, the apparatus combining a case cooling system with an arrangement for mechanically actuating shroud segments.

The mechanically actuated shroud segments allow the apparatus to react swiftly to transient events, while the case cooling system can accommodate more broadly the range of engine operating conditions. Thus the combination can overcome difficulties experienced with conventional rotor blade tip clearance control apparatuses. In particular, as the arrangement for mechanically actuating the shroud segments does not have to provide the entire range of movement for blade tip clearance control, an arrangement can be employed which is more reliable than conventional systems for mechanical actuation of shroud segments.

More specifically, a first aspect of the present invention proves a rotor blade tip clearance control apparatus for a gas turbine engine, the apparatus including:

- a plurality of circumferentially distributed segments which form an annular shroud surrounding the outer tips of a row of rotor blades,
- a mechanical arrangement operatively connected to the segments, wherein actuation of the arrangement causes the segments to move in a radial direction thereby controlling a clearance between the segments and the outer tips, and
- a case cooling system which supplies cooling air to an engine case to which the segments are mounted, the cooling air regulating thermal expansion of the case and thereby also controlling the clearance between the segments and the outer tips.

Preferably, the mechanical arrangement is a unison ring operatively connected to the segments, wherein circumferential movement of the unison ring causes the segments to move in a radial direction. The unison ring can provide a robust and reliable mechanical actuator, which is able to withstand the demanding operating conditions produced by the turbine stage of a gas turbine engine. Typically, the unison ring does not provide large amounts of segment movement in the radial direction. However, the movement that it does provide can be applied quickly and can be sufficient to provide adequate tip clearance control during engine transients. The case cooling system can then provide tip clearance control for larger, but more slowly developing, thermal excursions.

Preferably, each segment is rotationally mounted to a segment carrier, a spindle extends radially outwardly from each segment carrier to traverse the case and operatively connect to the unison ring such that circumferential movement of the unison ring causes the spindle to rotate, and a device, such as a cam or screw thread device, converts the rotational movement of each spindle into movement in the radial direction, whereby the corresponding segment also moves in the radial direction. Such an arrangement can also operate reliably in the turbine stage environment.

The case cooling system may have a manifold ring which delivers the cooling air to the case. The cooling air is typically delivered to a position on the case at or adjacent the blade tips. The cooling air can be delivered as a plurality of jets, for example as jets directed radially inwardly onto the case. Thus, the manifold ring may have a plurality of impingement holes e.g. on the radially inner side thereof which direct the cooling air delivered by the ring onto the case. However, if the case has, for example, a circumferentially extending outward projection or flange feature at the relevant position, the jets may be directed sideways, e.g. by suitably positioned impingement holes, onto a face of the feature.

Preferably, the unison ring forms the manifold ring.

Indeed, in general terms the present invention provides a combined drive and case cooling apparatus for a gas turbine engine, the apparatus including a unison ring, wherein circumferential movement of the unison ring drives engine rotor blade tip clearance control or engine stator vane rotation, and the unison ring also forms a manifold delivering cooling air to an engine case.

By combining the mechanical actuation functionality of the unison ring and the cooling air delivery functionality of the manifold in a single component, it is possible to make both weight and space savings. Further, because the unison ring can itself be cooled by the cooling air, the choice of materials from which the ring is formed can be broadened. Thus provides scope, for example, for cost savings and/or further weight reduction.

Thus a second aspect of the present invention provides a combined stator drive and case cooling apparatus for a gas turbine engine, the apparatus including:

a plurality of circumferentially distributed segments which form an annular shroud surrounding the outer tips of a row of rotor blades, a row of stator vanes, and a unison ring operatively connected to the stator vanes, circumferential movement of the unison ring causing the stator vanes to rotate about their radial axes;

wherein the unison ring also forms a manifold delivering cooling air to an engine case to which the segments are mounted, the cooling air regulating thermal expansion of the case and thereby controlling the clearance between the segments and the outer tips.

Typically the row of rotor blades is adjacent to the row of stator vanes. Typically, the unison ring is located radially outwardly of the segments.

The ring may have a plurality of impingement holes which direct the cooling air delivered by the ring onto the case. For example, the impingement holes may be on the radially inner side of the ring e.g. if cooling air is to be directed radially inwards.

A further aspect of the present invention provides a gas turbine engine having the rotor blade tip clearance control apparatus of the first aspect.

Another aspect of the present invention provides a gas turbine engine having the combined stator drive and case cooling apparatus of the second aspect.

Another aspect of the present invention provides a unison ring for the rotor blade tip clearance control apparatus of the first aspect when the unison ring forms the manifold ring, or for the combined stator drive and case cooling apparatus of the second aspect.

Figure 1B:
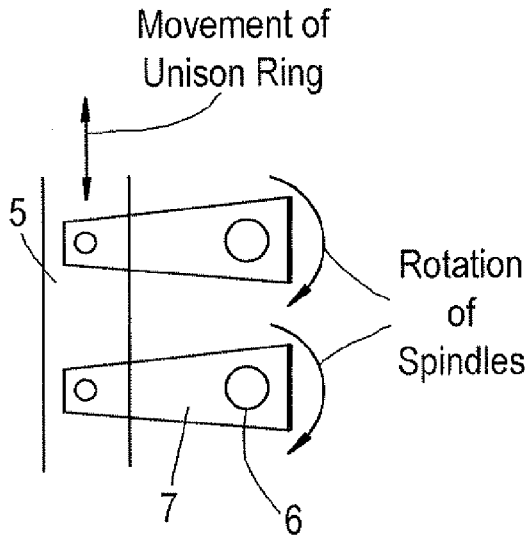
Figure 1C:
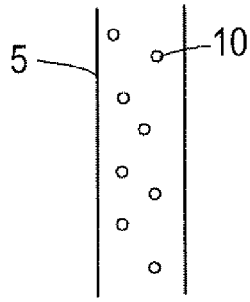
Figure 2A:
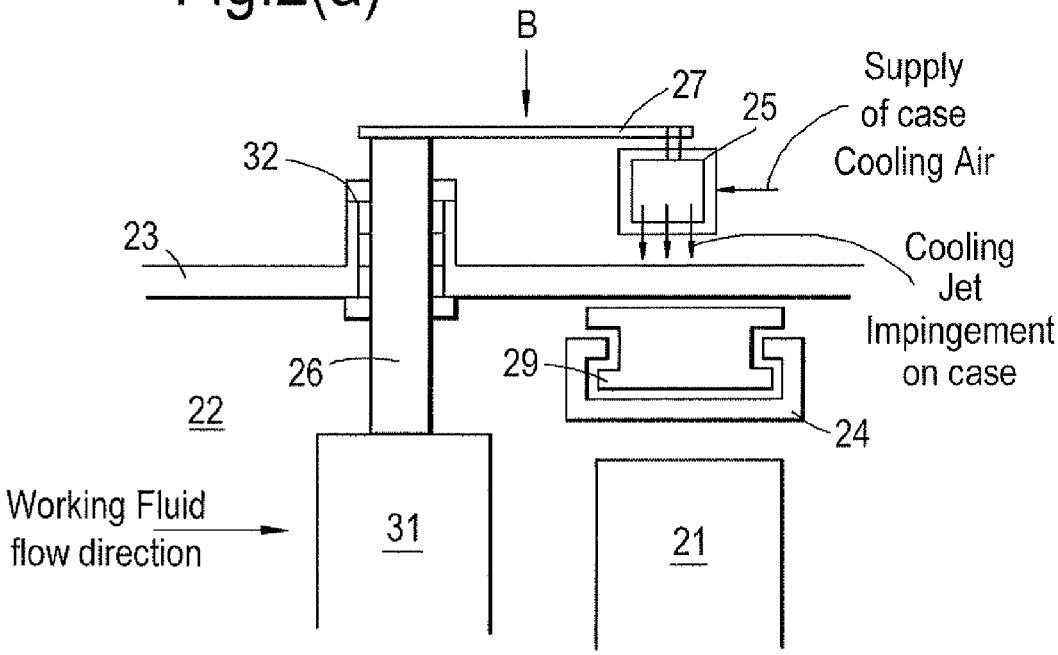
Figure 2B:
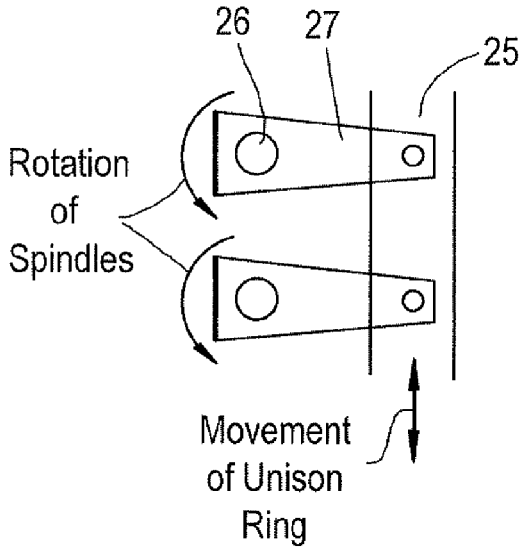
Figure 2C:
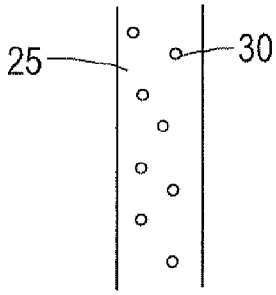

Embodiments of the invention will now be described by way of example with reference to the accompanying drawings in which:

FIG. 1(*a*) shows a schematic diagram of a tip clearance control apparatus for a turbine stage of a gas turbine engine, the apparatus having a combined unison ring and cooling air manifold, FIG. 1(*b*) is a view along direction A of the top side of the apparatus, and FIG. 1(*c*) is a view of the under side of the unison ring; and FIG. 2(*a*) shows a schematic diagram of a combined stator drive and case cooling apparatus of a gas turbine engine, the apparatus having a combined unison ring and cooling air manifold, FIG. 2(*b*) is a view along direction A of the top side of the apparatus, and FIG. 2(*c*) is a view of the under side of the unison ring; and FIG. 1(*a*) shows a schematic diagram of a tip clearance control apparatus for a turbine stage of a gas turbine engine, the apparatus having a combined unison ring and cooling air manifold.

The turbine stage has a rotor with turbine blades 1. The blades rotate in an annulus 2 which contains the flow of working fluid. An engine case 3 provides the outer wall of the annulus, and mounted to the case is a shroud for the rotor blades. The shroud extends circumferentially around the inside of the case and is formed from a plurality of shroud segments 4. To reduce leakage of working fluid over the radially outer tips of the blades, the clearance between the shroud segments and the tips of the blades should be kept as small as possible. The tips of the blades may optionally carry shrouds as well.

The tip clearance control apparatus combines a case cooling system with a mechanical arrangement in which a unison ring 5 causes the segments to move in a radial direction.

The unison ring 5 encircles the engine and is operatively connected to the segments 4 by a system of levers and spindles. Each segment 4 is rotatably mounted to a segment carrier 9. A spindle 6 extends radially outwardly from each segment carrier to pass through the wall of the case 3. The external end of the spindle is joined to one end of a lever 7, the other end of the lever being rotatably connected to the unison ring. As shown schematically in FIG. 1(*b*), which is view along direction A, movement of the unison ring in its circumferential direction causes the levers to turn about their joints with the spindles. This in turn causes rotation of the spindles and the segment carriers. The segments, being rotatably mounted to segment carriers and interconnected to form the shroud, do not rotate. However, a cam or screw thread device 8 at the point where each spindle passes through the case 3 converts the rotation of the spindle into a translational movement in the radial direction of the engine, whereby the segment carriers and the segments are also moved the radial direction. In this manner, tip clearance control is effected by actuation of the unison ring.

The unison ring arrangement is robust and reliable and can allow appropriate tip clearances to be maintained during fast engine transients. However, in general, the extent of radial movement permitted by the unison ring is insufficient to provide appropriate tip clearances over the full range of engine operating conditions. For this reason the case cooling system is also employed.

Advantageously, the unison ring 5 forms a part of the case cooling system by providing a manifold for the supply of cooling air, which is typically diverted from the fan stream or an early compressor stage of the engine. The double function of the unison ring allows mechanically actuated and case cooling tip clearance control to be provided even when there are space restrictions around the case 3.

The unison ring 5 is hollow so that it can deliver the cooling air. Further, as shown schematically in FIG. 1(*c*), which is a view of the under side of the ring, it has a plurality of impingement holes 10 formed in its radially inner side, which cause the cooling air to exit the ring in jets. These jets impinge on the outer surface of the case 3, causing significant cooling and hence contraction of the case. The peak contraction is directly under the jets, which might typically be distributed in a pattern which covers an area extending about 30-70 mm in the axial direction of the engine. However, some contraction of the case can be produced up to an axial distance of about 100 mm to either side of the jets.

As well as saving space, the dual-function of the unison ring 5 saves weight, reduces part counts, can save costs, and allows a wider range of materials to be used to form the ring. For example, as the ring is cooled, it may be formed of relatively lightweight, but lower melting point material.

The dual-function ring offers further advantages in respect of its locating arrangement. A conventional cooling manifold is connected directly to the outer case, usually by fasteners on to a radial projection such as a flange or lug. In contrast, the concentricity of a unison ring can be maintained by a set of centralising rods which project inwards from the ring and slide on a set of low-friction pads on the outer surface of the case as the ring is moved circumferentially. Thus the dual function ring (a) can dispense with the need for the direct connection to the outer case, thereby avoiding potential thermal stress problems and also simplifying the case outer profile, and (b) can direct cooling on to the low friction pads, thereby simplifying the choice of pad material and pad adhesive.

FIG. 2(*a*) shows a schematic diagram of a combined stator drive and case cooling apparatus of a gas turbine engine, the apparatus having a combined unison ring and cooling air manifold.

Again, the turbine stage has a rotor with turbine blades 21 which rotate in an annulus 22, and an engine case 23 provides the outer wall of the annulus. A shroud for the rotor blades formed from a plurality of shroud segments 24 is mounted to the case. The shroud segments are carried by respective segment carriers 29. The tips of the blades may optionally carry shrouds.

The turbine stage also has a row of stator vanes or nozzle guide vanes 31 upstream of the turbine blades. The stator vanes redirect the working fluid before it impinges on the rotor blades. For efficient operation of the engine, the aerodynamic flow angle of the stator vanes is alterable by rotating the blades.

A spindle 26 extends radially outwardly from each stator vane to pass through the wall of the case 23. Bushes or bearings 32 provide radial location for the spindle, but allow it to rotate relative to the case. The external end of the spindle is joined to one end of a lever 27, the other end of the lever being rotatably connected to a unison ring 25 which encircles the engine.

As shown schematically in FIG. 2(*b*), which is view along direction B, movement of the unison ring in its circumferential direction causes the levers 27 to turn about their joints with the spindles 26. This in turn causes rotation of the spindles and stator vanes 31.

However, the unison ring 25, being hollow, has a second function, which is to serve as a manifold for the supply of cooling air in a case cooling system. As shown schematically in FIG. 2(*c*), which is a view of the under side of the ring, it has a plurality of impingement holes 30 formed in its radially inner side. The holes cause the cooling air to exit the ring in jets which impinge on the outer surface of the case 23 at the position of the segment carriers 29. The cooling and contraction of the case at this position caused by the jets allows provides tip clearance control between the segments 24 and the tips of the rotor blades 21.

Thus, the dual-function unison ring 25 provides advantages similar to those of unison ring of the tip clearance control apparatus of FIG. 1.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A rotor blade tip clearance control apparatus for a gas turbine engine, the apparatus including:

a plurality of circumferentially distributed segments which form an annular shroud surrounding outer tips of a row of rotor blades, a mechanical arrangement operatively connected to the segments, wherein actuation of the mechanical arrangement causes the segments to move in a radial direction thereby controlling a clearance between the segments and the outer tips, and a case cooling system which supplies cooling air to an engine case to which the segments are mounted, the cooling air regulating thermal expansion of the case and thereby also controlling the clearance between the segments and the outer tips, wherein:

the case cooling system has a manifold ring which delivers the cooling air to the case, the mechanical arrangement is a unison ring operatively connected to the segments, circumferential movement of the unison ring causes the segments to move in a radial direction, and the unison ring forms the manifold ring.

2. A rotor blade tip clearance control apparatus according to claim 1, wherein the mechanical arrangement is a unison ring operatively connected to the segments, circumferential movement of the unison ring causing the segments to move in a radial direction.

3. A rotor blade tip clearance control apparatus according to claim 2, wherein:

each segment is rotationally mounted to a segment carrier, a spindle extends radially outwardly from each segment carrier to traverse the case and operatively connect to the unison ring such that circumferential movement of the unison ring causes the spindle to rotate, and a cam or screw thread device converts the rotational movement of each spindle into movement in the radial direction, whereby the corresponding segment also moves in the radial direction.

4. A rotor blade tip clearance control apparatus according to claim 1, wherein the manifold ring has a plurality of impingement holes which direct the cooling air delivered by the manifold ring onto the case.

5. A gas turbine engine having the rotor blade tip clearance control apparatus of claim 1.

6. A unison ring for the rotor blade tip clearance control apparatus of claim 1.

7. A combined stator drive and case cooling apparatus for a gas turbine engine, the apparatus including:

a plurality of circumferentially distributed segments which form an annular shroud surrounding outer tips of a row of rotor blades, a row of stator vanes, and a unison ring operatively connected to the stator vanes, circumferential movement of the unison ring causing the stator vanes to rotate about their radial axes;

wherein the unison ring also forms a manifold delivering cooling air to an engine case to which the segments are mounted, the cooling air regulating thermal expansion of the case and thereby controlling the clearance between the segments and the outer tips.

8. A combined stator drive and case cooling apparatus according to claim 7, wherein the row of rotor blades is adjacent to the row of stator vanes.

9. A combined stator drive and case cooling apparatus according to claim 7, wherein the unison ring is located radially outwardly of the segments.

10. A combined stator drive and case cooling apparatus according to claim 7, wherein the ring has a plurality of impingement holes which direct the cooling air delivered by the ring onto the case.

11. A gas turbine engine having the combined stator drive and case cooling apparatus of claim 7.

12. A unison ring for the combined stator drive and case cooling apparatus of claim 7.

* * * * *